United States Patent [19]

Santucci

[11] 4,031,925

[45] June 28, 1977

[54] DEVICE FOR CUTTING THE WEFT IN A SHUTTLELESS LOOM HAVING A CONTINUOUS WEFT-SUPPLY MECHANISM

[75] Inventor: Nicola Santucci, Schio, Italy

[73] Assignee: Nuovo Pignone, S.p.A., Florence, Italy

[22] Filed: Apr. 29, 1975

[21] Appl. No.: 572,652

[30] Foreign Application Priority Data

Apr. 30, 1974 Italy ..... 22104/74

[52] U.S. Cl. ..... 139/429; 139/302; 139/453

[51] Int. Cl.[2] ..... D03D 47/00; D03D 47/38; D03D 49/70

[58] Field of Search ..... 139/122 R, 122 W, 127 R, 139/302, 303, 263, 429, 430, 453; 66/145

[56] References Cited

UNITED STATES PATENTS

| | | | |
|---|---|---|---|
| 3,380,482 | 4/1968 | Scherillo | 139/122 R |
| 3,487,436 | 12/1969 | Svaty et al. | 139/303 X |
| 3,530,902 | 9/1970 | Stingl | 139/122 R |
| 3,621,885 | 11/1971 | Egloff et al. | 139/122 R |
| 3,814,140 | 6/1974 | Serturini | 139/302 |
| 3,951,177 | 4/1976 | Santucci | 139/453 X |

*Primary Examiner*—James Kee Chi
*Attorney, Agent, or Firm*—Ralph M. Watson

[57] ABSTRACT

Weft-cutting apparatus for a shuttleless loom of the type having a continuous weft supply and in which a selected weft thread coming from a fixed bobbin mounted at a point spaced from the fabric prepared on the loom remains attached to the edge of that fabric during the movement of a picking needle inside the shed and until after it has been beaten into the fabric, is constructed of an upper L-shaped lever and a lower L-shaped lever, fulcrumed at their midpoint on a common pin to provide a gap between them which is located in the path of the weft thread. Each lever supports a transverse cutting blade at one end and, at its other end, a sliding roller which rides on an associated control cam. Springs attached to the levers force the sliding rollers against their associated control cams which are keyed to a common shaft that is rotated with the drive shaft of the loom, and are shaped so that the levers are pivoted and the blades are brought together to sever the weft thread during one phase of the revolution of the shaft and are separated from each other during another phase of the revolution of that shaft.

5 Claims, 5 Drawing Figures

DEVICE FOR CUTTING THE WEFT IN A SHUTTLELESS LOOM HAVING A CONTINUOUS WEFT-SUPPLY MECHANISM

The present invention relates to an improved weft cutting device for a shuttleless loom having a continuous weft-supply mechanism in which the weft thread, coming from a fixed bobbin mounted outside the fabric, remains attached to the edge of the fabric and so has to be cut for insertion into the warp shed by inserting and traction needles.

More specifically this invention is particularly designed for use with looms of the type described in U.S. Pat. No. 3,380,482, owned by the assignee of this application. Such looms make use of different weft threads preselected by a selecting mechanism and passing through gap between the cutters of the cutting device, the selected weft thread being guided between the shearing edges of the cutters, during the displacement of the inserting needle towards the inside of the warp shed, by a finger projecting from the inner end of the cutting blade of the lower cutter.

From the prior art there are known weft cutting devices mounted on shuttleless looms, but all these known devices present cutting drawbacks essentially due to the kinematic type of motion used which by its constructional shape causes clearances on cutting cutters, this drawback moreover is caused by the shape and by the driving type of the cutters movement which does not allow a contemporaneous motion and with shiftings at will of both the cutters in condition of cutting (shearing effect) with consequent imperfect cutting to the specific construction type of the cutting blades, which never maintain constant the entity of the interference among cutting edges of said cutters during the cutting phase and furthermore do not permit recovery of possible construction clearances in order to have uniform interference.

It is the object of the present invention to obviate the aforesaid drawbacks and to furnish an improved device for cutting the weft which to make it possible to eliminate or to reduce minimum the clearances between the cutters, to move the said cutters contemporaneously at will, to maintain the interference among the cutters constant during the whole cutting phase and to insure that the cut of the weft, positioned around a nose, does not occur at the side edge of the two cutters, but in a central zone in which said cutters are perfectly sharp.

According to the present invention, the weft cutting device consists of two mobile cutters constituted by two levers having an L shape fulcrumed at the middle part on the same pin, each of which supports at one extremity and in a transverse direction a cutting edge at whose other extremity a sliding roller cooperates with a driven cam having a particular shape, the contact between said roller and said cam being assured by a spring and the two cams being keyed to the same main shaft.

The simplicity of construction of such a device guarantees the elimination of clearances by said springs, whereas the use of control cams having different shapes make it possible to obtain the desired movements of the cutters.

According to another feature of our invention the two cutting edges mounted transversely at one extremity respectively of the mobile cutters, present conical surfaces having an axis coincident with the pin axis on which they are fulcrumed.

In such a way, the contact between the cutting edges of the blades is maintained constant during the whole shifting of the movable cutters and during all the cutting phase. According to another feature of the invention the upper cutting edge is mounted to rotate around a horizontal pin in a vertical groove at the front extremity of the upper movable cutter. It is held, by means of a spiral spring whose reaction intensity is adjustable by means of a system constituted by a screw and nut, with its inside conical surface in contact with a shoulder screw, adjustable in position by means of a nut, so as to be slightly inclined toward the inside and the external conical surface of the lower cutting blade.

In such a way, by varying the position of the said shoulder screw and therefore the position of the inside conical surface of the upper cutting blade with respect to the external conical surface of the lower cutting blade, it is possible to achieve construction clearances and the wished interference degree between the cutting edges of said cutting blades, whereas by acting on said nut screw system it is possible to vary the reaction of the helicoidal spring and therefore it is possible to adjust appropriately the pressure of the upper cutting blade on the lower cutting blade with relation to the different types of wefts to be cut.

According to another feature of the invention the lower cutting blade brings in its inside extremity adjacent to the gap space between the cutting blades, a conical nose guiding of the weft to be cut, which is faceted at anangle of about 60° on its side adjacent to the cutting edge of the blade.

In such a way the weft to be cut, which is obliged to wind itself around said nose in consequence to the shifting of the picking needle toward the inside of the shed, is positioned above the cutting edge of the lower cutting blade, no longer along its side edge but in a medium zone where the cuts of the cutting blades have a perfect edge.

The invention will now be explained with reference to the accompanying drawings which illustrate preferred embodiment given only by way of an illustrative example since variations in construction can practically be effected within the limits of the present invention.

Figure 1:
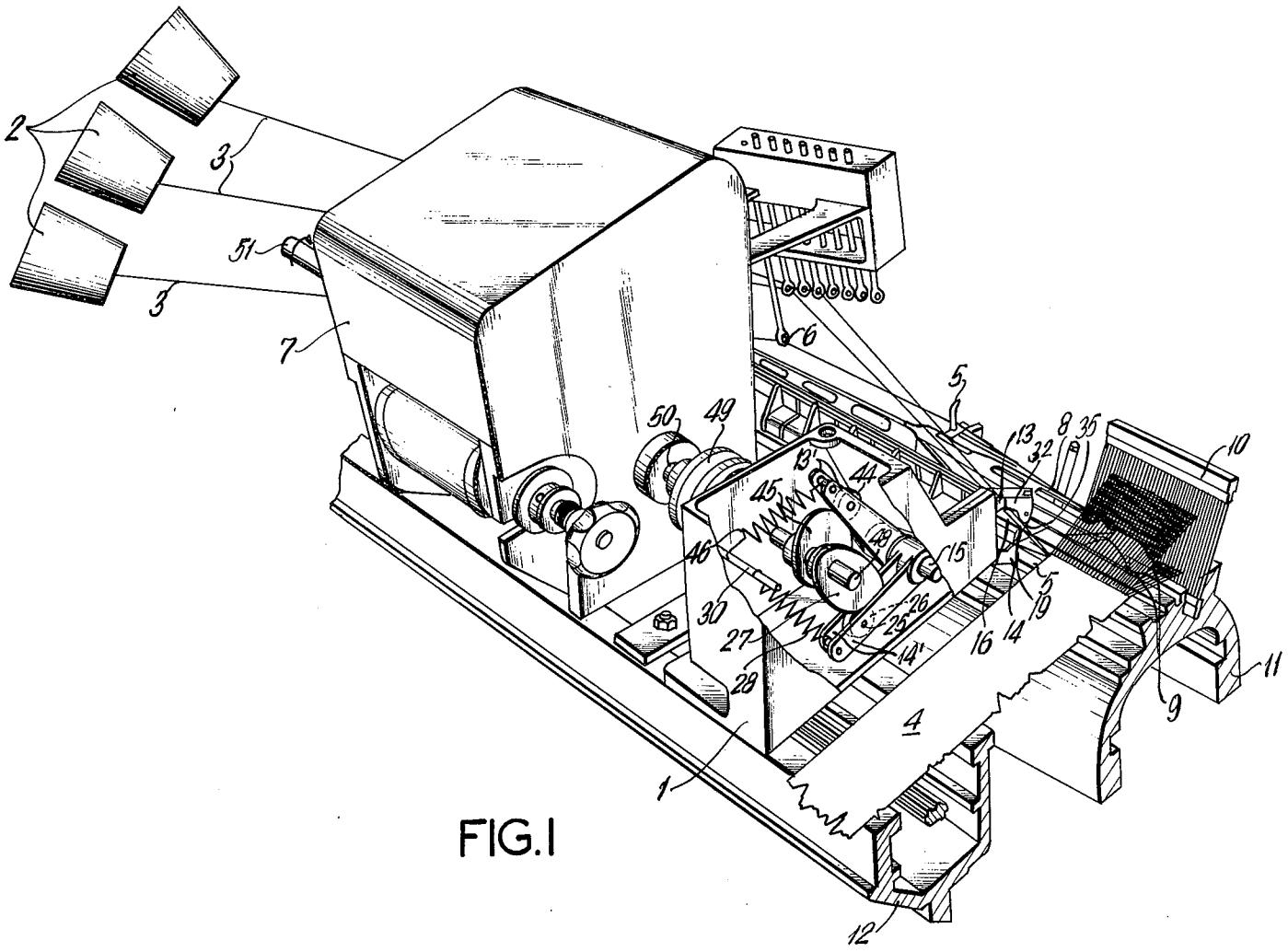
FIG. 1 is a perspective, partially sectioned, view the side of a shuttleless loom equipped with the cutting device of my invention.

With reference to the drawings, and in particular FIG. 1, 1 indicates the box of the cutting device according to the invention, 2 the fixed bobbins, set up at a distance from the fabric, from which are kept the weft 3 to weave which remain attached to the edge of the forming weave 4, 5 indicates the weft to be cut and to be inserted, which, presented by selector single 6 of the selection and presentation device 7 in front to the insertion needle 8, is by this inserted in the warp shed formed by warp threads 9 and by the reed 10 which, fixed to the slay 11 of the shuttleless loom, carries out the beating of said weft 5 when it is inserted.

The cutting device according to the present invention, which is assembled in a fixed position on the breast beam 12 of the loom in such a way that its two cutters graze the first tooth of the comb when it is in position of beating up the weft, comprises two movable cutters 13 and 14 substantially constituted by two levers, each having an L shape, which are fulcrumed in at their mid part on the same pin 15, supported by side walls of the box 1, in order to form between then a gap 16 through the which pass the weft threads 3 which have been previously beaten in the fabric 4, and which remain linked to said fabric and to the selection device 7.

The lower front part of movable cutter 14 ends in a transversely projecting side 17, on the front of which is fixed, by means of screws 18, the cutting blade 19.

Figure 5:
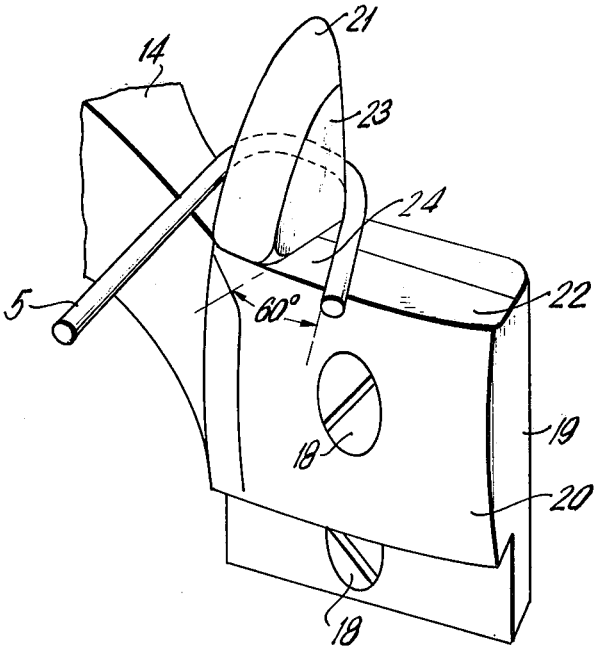
FIG. 5 is an enlarged perspective view of the lower cutting blade of the cutting device of my invention, showing also the position assumed by the weft to be cut around to the nose.

Said lower cutting blade 19 has an external surface 20 which is a conical surface whose axis is coincident with the axis of the pin 15 on which are fulcrumed the movable cutters 13 and 14. Blade 19 bears at its inside extremity and adjacent to said gap space 16, formed between the movable cutters, a conical nose 21 which presents in its side adjacent to the cutting edge 22 of the blade a faceting 23 (see FIG. 5) at an angle of about 60°. In this way the cutting edge 22 of the blade 19 can be prolonged in the zone 24 (see FIG. 5) and the weft thread 5 to be cut which winds itself around said nose, is no longer cut in correspondence of the lateral cutting edge but in this medium zone where the cut is more efficient.

The back part of the lower movable cutter 14 is constituted by two spaced, parallel arms 14′ supporting between them the pin 25 of an idle sliding roller 26 which is kept in contact with a control cam 27 by means a spring 28, connected to the pin 29, supported by the side walls of the box 1.

Figure 2:
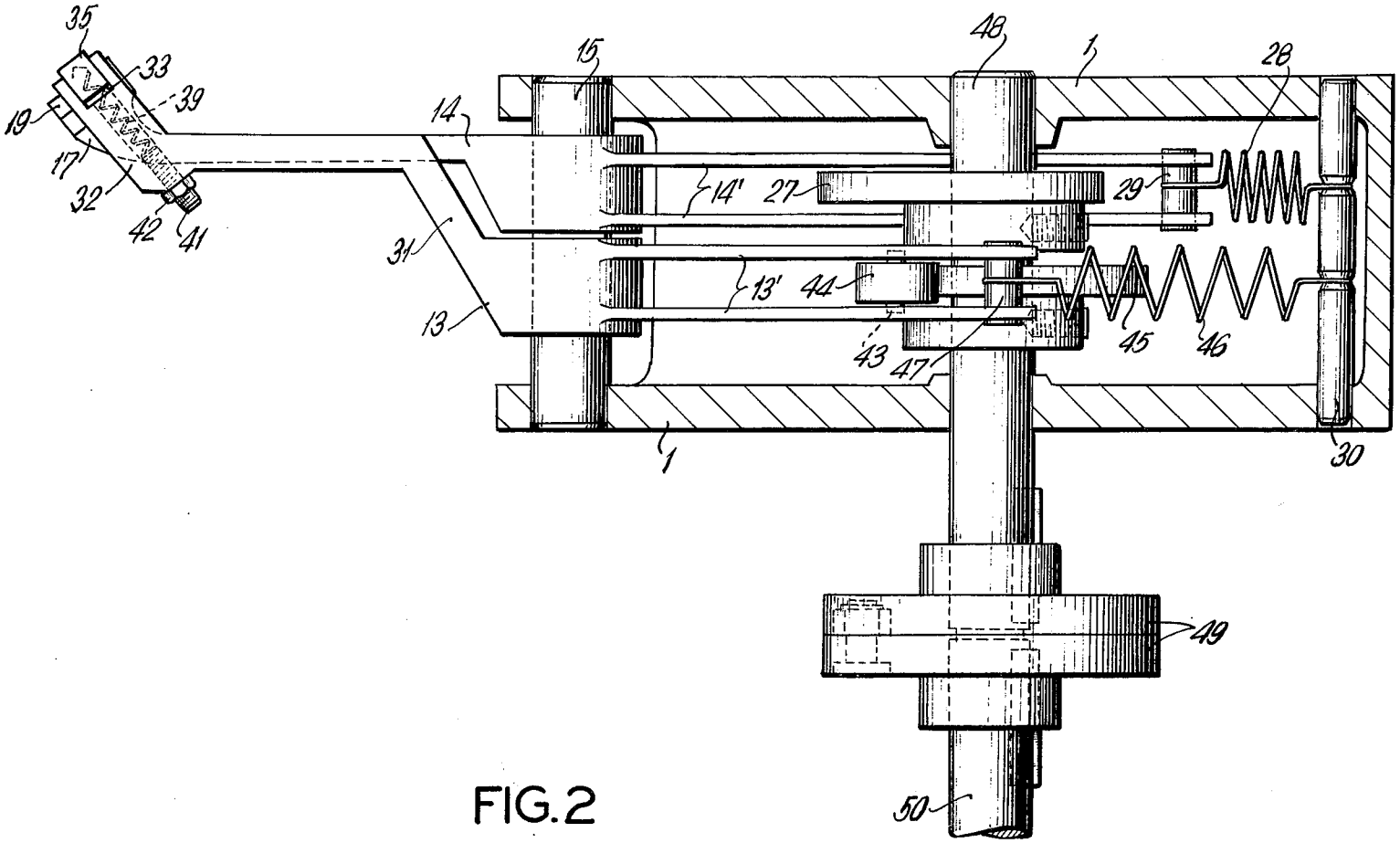
FIG. 2 is a plan view, on an enlarged scale, of the cutting device of FIG. 1.
Figure 3:
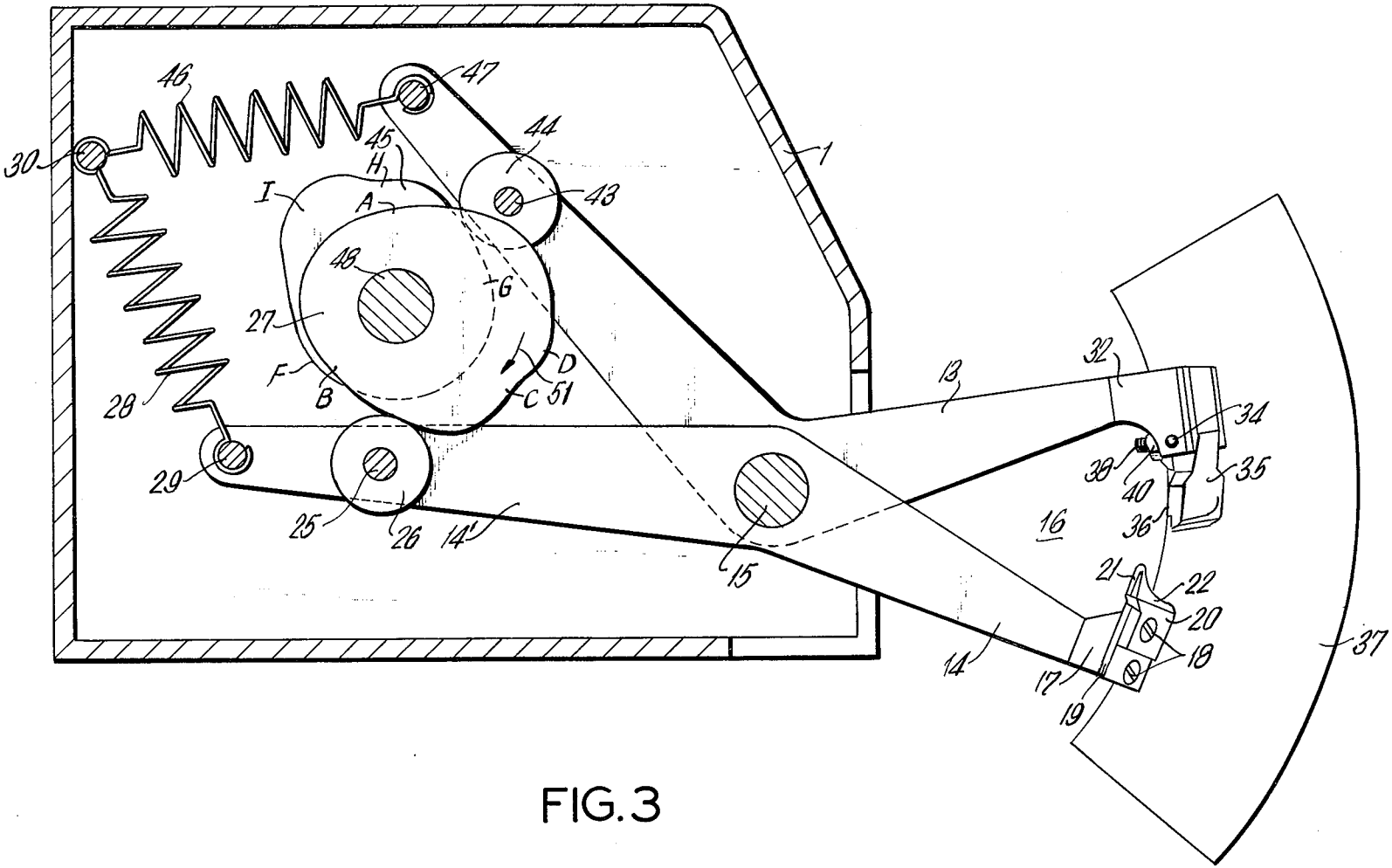
FIG. 3 is a side sectional view of the cutting device of FIG. 2.
Figure 4:
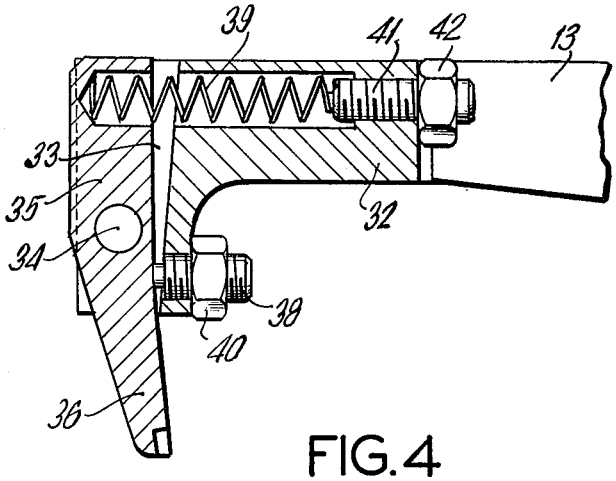
FIG. 4 is an enlarged side sectional view of the upper cutting blade of the cutting device of my invention.

The upper movable cutter 13 has a deviation 31 (see FIG. 2) adapting it to be placed on the lower cutter 14 and ends frontally with a transverse projecting side 32 containing in its front extremity a vertical groove 33 in which there is a horizontal pin 34 that rotatably supports the upper cutting blade 35. Said cutting blade 35 presents the inside surface 36, in contact, during the cutting phase, with the external surface 20 along a conical surface having an axis coincident with the axis of the pin 15 on which are fulcrumed the movable cutters 13 and 14 (in FIG. 3 there is shown by 37 a part of said conical surface of the two cutting blades) and is kept pressed, in a slightly inclined position toward said surface 20, against a shoulder screw 38 supported by the lower part of the body 32, by a spiral spring 39 which is housed in corresponding recesses of the blade 35 and of the said body 32 as best shown in FIG. 4. The position of shoulder screw 38 can be changed by acting on nut 40 and the pressure exerted by spring 39 can be regulated by means of screw system 41 - nut 42 supported by body 32.

The back side of the upper movable cutter 13 is constructed similarly to the lower movable cutter 14, by two parallel, spaced arms 13′ supporting the pin 43 of a sliding idle roller 44 which is kept in contact with a control cam 45 by a spring 46 connecting the pin 47, supported at the extremity of said arms 13′, with said stationary shaft 30. The two cams 27 and 45 are both keyed to the same main shaft 48 which is supported by the side walls of the box 1 of the cutting device parallel to the pin 15. Shaft 48 is connected, by means of flange coupling 49, to the drive shaft 50 coming from selection and presentation device 7 which rotates at the same speed as the loom crankshaft.

In this way it is guaranteed that the movement of the cutters 13 and 14 is co-ordinated with the movements of the slay 11, of the weft selector 7 and of the transfer needle 8.

The control cams 27 and 45 are shaped so as to present a profile suitable to give to the cutters 13 and 14 the desired movements. In particular, as shown in FIG. 3, the two cams 27 and 45 are shaped so that, by rotating in the direction of the arrow 51, there is a stage preceding the cutting and corresponding to lengths BC and GH, respectively, during which the lower cutter 14 and the upper cutter 13 approach each other by lifting and lowering, respectively. The nose 21 is thus positioned adjacent to the weft threads coming from the selector and compels the weft threads selected and inserted in the shed by the transfer needle to rotate around said nose: There is then a cutting phase corresponding to lengths CD and HI, respectively, during which there is obtained the simultaneously crossing of the cutting blades of said cutters, with the consequent cutting of the selectioned weft: There is then the return phase to the initial position, corresponding to the lengths DA and IF, respectively, when there is obtained the opening of the cutters. At this moment there is a rest stage corresponding to lengths AB and FG respectively, of said cams during which the cutters blades are open.

I claim:

1. Weft-cutting apparatus for a shuttleless loom of the type having a drive shaft and a continuous weft supply, in which a selected weft thread coming from a fixed bobbin mounted at a point spaced from the fabric prepared on said loom remains attached to the edge of said fabric during the movement of a picking needle inside rhe shed and until after said weft thread has been beaten into the fabric, comprised of an upper L-shaped lever, an oppositely disposed lower L-shaped lever, a stationary pin upon which said L-shaped levers are fulcrumed at their midpoint so that a gap is provided between said levers along the path of said selected weft thread and said levers are adapted to be pivoted about said fulcrum between open non-cutting position and closed cutting position, a first transverse cutting blade fixed to the inner end of the upper lever, a second transverse cutting blade pivoted to the inner end of the upper lever and adapted to bear against said first transverse blade when the levers are in closed position, resilient means for urging said second transverse blade to pivot toward the first transverse blade when the levers are in closed position, a stub shaft mounted for rotation with said drive shaft, a first control cam keyed to said stub shaft, a second control cam keyed to said stub shaft, a first roller mounted on the outer end of the upper lever to ride over the surface of the first cam, a second roller mounted on the outer end of the lower lever to ride over the surface of the second cam, and springs attached to said levers to urge said rollers against their associated cams so that said levers are pivoted from open position to closed position and return during each revolution of said stub shaft.

2. Weft-cutting apparatus for a shuttleless loom as claimed in claim 1, wherein each of said transverse cutting blades has a surface which corresponds with a surface of a cone whose axis is coincident with the axis of said stationary pin.

3. Weft-cutting apparatus for a shuttleless loom as claimed in claim 1, wherein said resilient means for urging the second transverse blade to pivot is comprised of an adjustable spring bearing against said second transverse blade, and a set screw extending from the inner end of the upper lever toward said blade to limit the pivotal motion thereof.

4. Weft-cutting apparatus for a shuttleless loom as claimed in claim 1, wherein a conical nose projects from the inner end of the lower lever adjacent the inner end of its cutting blade and is adapted to guide said selected weft thread to cutting position between said cutting blades as the levers are pivoted to closed position.

5. Weft - cutting apparatus for a shuttleless loom as claimed in claim 4, wherein the conical nose is faceted at an angle of about 60° on its side adjacent to the edge of its cutting blade.

* * * * *